US009046060B2

(12) United States Patent
Takagi et al.

(10) Patent No.: US 9,046,060 B2
(45) Date of Patent: Jun. 2, 2015

(54) FUEL VAPOR LEAKAGE SENSING APPARATUS AND FUEL VAPOR LEAKAGE SENSING METHOD USING THE SAME

(71) Applicant: Denso Corporation, Kariya, Aichi-pref. (JP)

(72) Inventors: Kosei Takagi, Nagoya (JP); Mitsuyuki Kobayashi, Gamagori (JP)

(73) Assignee: DENSO CORPORATION, Kariya (JP)

( * ) Notice: Subject to any disclaimer, the term of this patent is extended or adjusted under 35 U.S.C. 154(b) by 206 days.

(21) Appl. No.: 13/768,646

(22) Filed: Feb. 15, 2013

(65) Prior Publication Data

US 2013/0213365 A1 Aug. 22, 2013

(30) Foreign Application Priority Data

Feb. 17, 2012 (JP) ..... 2012-32756

(51) Int. Cl.
*F02M 25/08* (2006.01)

(52) U.S. Cl.
CPC ..... *F02M 25/08* (2013.01); *F02M 25/0818* (2013.01)

(58) Field of Classification Search
CPC ..... F02M 25/0818; F02M 25/0836; F02M 25/0845; F02M 25/0872; F02M 25/089
USPC ..... 123/518–521; 73/114.39, 114.43, 73/114.77; 701/114, 107
See application file for complete search history.

(56) References Cited

U.S. PATENT DOCUMENTS 6,722,348 B2 * 4/2004 Nagasaki et al. ..... 123/520
6,761,154 B2 * 7/2004 Takagi et al. ..... 123/520
6,964,193 B2 * 11/2005 Kobayashi et al. ..... 73/114.39
6,973,924 B1 * 12/2005 Suzuki ..... 123/519
7,287,396 B2 * 10/2007 Maier et al. ..... 62/200
2005/0044937 A1 3/2005 Kobayashi et al.
2007/0189907 A1 8/2007 Kunihiro et al.
2009/0277427 A1 11/2009 Yoshimura

FOREIGN PATENT DOCUMENTS

JP 2005-291122 10/2005
JP 2006-257937 9/2006
JP 2007-218161 8/2007
JP 2008-025469 2/2008
JP 2009-270494 11/2009

OTHER PUBLICATIONS

U.S. Appl. No. 13/616,595, Takagi et al., filed Sep. 14, 2012.
U.S. Appl. No. 13/616,595 of Takagi, filed Sep. 14, 2012.

* cited by examiner

*Primary Examiner* — Lindsay Low
*Assistant Examiner* — Robert Werner
(74) *Attorney, Agent, or Firm* — Nixon & Vanderhye, P.C.

(57) ABSTRACT

An operation of a change valve is changeable between a valve closing state, in which the change valve is closed to close connection between a pump passage and a canister passage and to open connection between an atmosphere passage and the canister passage, and a valve opening state, in which the change valve is opened to open the connection between the pump passage and the canister passage and to close the connection between the atmosphere passage and the canister passage. An ECU determines that the change valve is abnormal when a value, which is obtained by subtracting a second reference pressure measured in an (n−1)th execution of a fuel vapor leakage sensing process from a first reference pressure measured in an nth execution of the fuel vapor leakage sensing process, is equal to or larger than a predetermined threshold value.

4 Claims, 6 Drawing Sheets

COMPLETE VALVE CLOSING STATE

INCOMPLETE VALVE CLOSING STATE

COMPLETE VALVE CLOSING STATE

START
MEASURE ATMOSPHERIC PRESSURE P0
S101
MEASURE Pr1
S102
S103
Ps2 ≤ Pr1 ≤ Ps1 ?
NO
YES
S104
(n)Pr1-(n-1)Pr2 < Pd3 ?
NO
YES
TURN ON CHANGE VALVE
S105
MEASURE Pt
S106
S107
Pt < Ps4 ?
NO
YES
S108
S109
DETERMINE LEAKAGE < LIMIT VALUE
DETERMINE LEAKAGE ≥ LIMIT VALUE
S112
TURN OFF CHANGE VALVE
S110
DETERMINE ABNORMALITY OF CHANGE VALVE
MEASURE Pr2
S111
END

FIG. 6 (n-1)th EXECUTION OF FUEL VAPOR LEAKAGE SENSING PROCESS
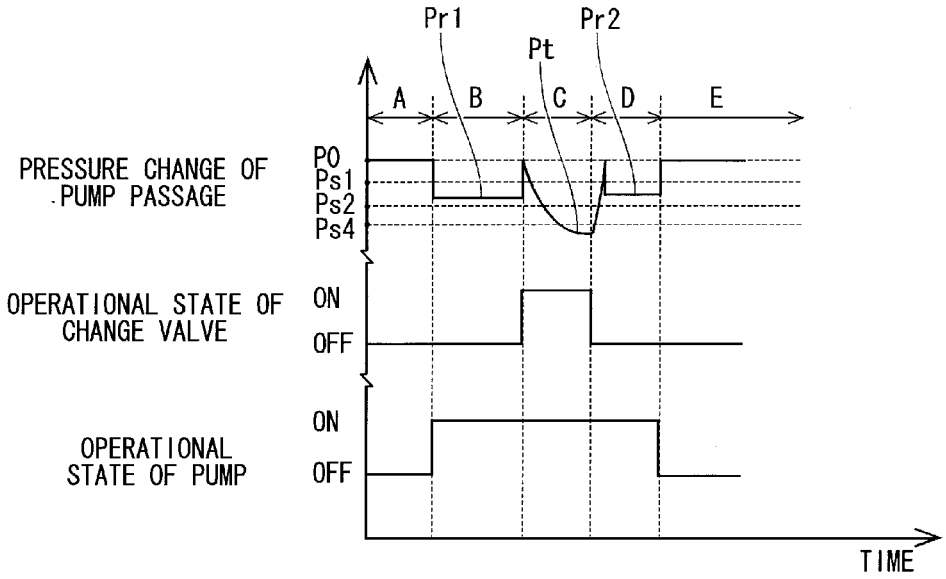
FIG. 7 nth EXECUTION OF FUEL VAPOR LEAKAGE SENSING PROCESS
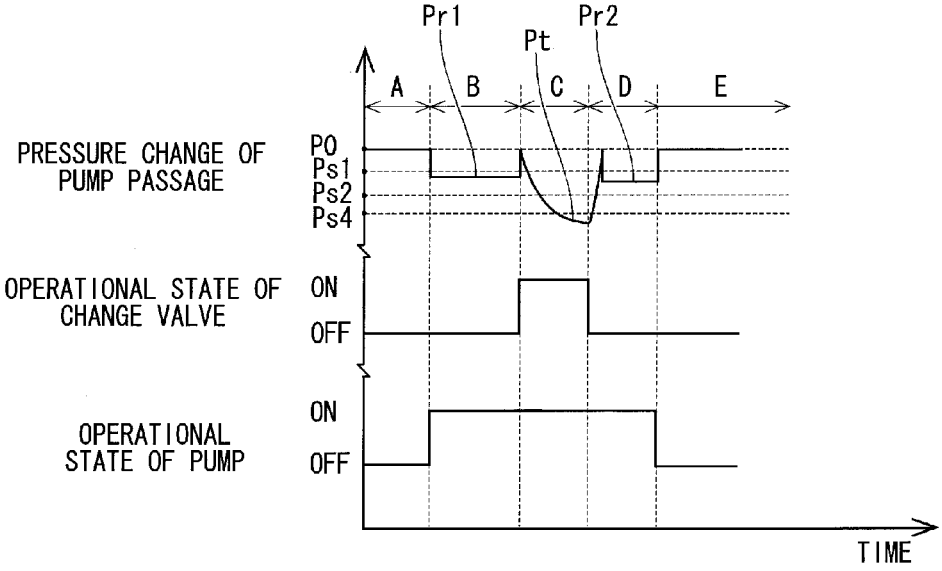

FUEL VAPOR LEAKAGE SENSING APPARATUS AND FUEL VAPOR LEAKAGE SENSING METHOD USING THE SAME

CROSS REFERENCE TO RELATED APPLICATION

This application is based on and incorporates herein by reference Japanese Patent Application No. 2012-32756 filed on Feb. 17, 2012.

TECHNICAL FIELD

The present disclosure relates to a fuel vapor leakage sensing apparatus and a fuel vapor leakage sensing method using the same.

BACKGROUND

A fuel vapor leakage sensing apparatus, which senses leakage of fuel vapor generated in a fuel tank, is known. For instance, JP2005-069878A (corresponding to US2005/0044937A1) recites a fuel vapor leakage sensing apparatus that uses a change valve to open or close connection between a passage, which is communicated with a fuel tank, and a passage, which is communicated with the atmosphere, or a passage, which is communicated with a pump. When a pressure in an inside of the fuel tank does not decrease to a first predetermined threshold value upon depressurization of the inside of the fuel tank with the pump, it is determined that the amount of leakage of the fuel vapor is equal to or larger than a limit value.

In the fuel vapor leakage sensing apparatus of JP2005-069878A (corresponding to US2005/0044937A1), a first valve element, which is formed separately from a valve shaft of the change valve, opens or closes an end portion of a communication passage synchronously with movement of the valve shaft of the change valve. In this case, the first valve element is tiltable relative to the valve shaft within a predetermined angular range to absorb variations in the perpendicularity and/or the coaxiality of each corresponding component. Thereby, at the valve closing time, when the first valve element is seated against a first valve seat upon tilting of the first valve element relative to the valve shaft, seal leakage may possibly be generated between the first valve element and the first valve seat. Since it is necessary to sense the leakage of the fuel vapor based on the pressure, which is measured at the valve closing time of the first valve element, the leakage of the fuel vapor cannot be accurately sensed in the case where the seal leakage is generated between the first valve element and the first valve seat.

Here, the seal leakage between the first valve element and the first valve seat can be sensed by determining whether the pressure, which is measured at the valve closing time of the first valve element, is within a predetermined pressure range. However, in the case where the seal leakage is generated due to the presence of the small amount of foreign object(s), it is not possible to sense the seal leakage between the first valve element and the first valve seat through the determination of whether the pressure, which is measured at the valve closing time of the first valve element, is within the predetermined pressure range. Therefore, when the seal leakage is generated due to the presence of the small amount of foreign object(s), an adverse influence may be imposed on the sensing accuracy of the fuel vapor leakage.

SUMMARY

The present disclosure is made in view of the above disadvantage. According to the present disclosure, there is provided a fuel vapor leakage sensing apparatus, which generates a pressure difference between an inside and an outside of a fuel tank to sense leakage of fuel vapor from the fuel tank. The fuel vapor leakage sensing apparatus includes a pump, a housing, a change valve, a pressure sensing device and a control device. The housing receives the pump. The housing includes a pump passage, a fuel tank passage and an atmosphere communication passage. The pump passage is connected to the pump through one end portion of the pump passage. The fuel tank passage is communicated with the fuel tank through one end portion of the fuel tank passage and is connected to the other end portion of the pump passage, which is opposite from the one end portion of the pump passage, through the other end portion of the fuel tank passage, which is opposite from the one end portion of the fuel tank passage. The atmosphere communication passage is opened to the atmosphere through one end portion of the atmosphere communication passage and is connected to the other end portion of the fuel tank passage through the other end portion of the atmosphere communication passage, which is opposite from the one end portion of the atmosphere communication passage. The change valve is placed in the housing. The pump passage and the atmosphere communication passage are located on one side of the change valve, and the fuel tank passage is located on the other side of the change valve, which is opposite from the one side of change valve. An operational state of the change valve is changeable between a valve closing state and a valve opening state. In the valve closing state, the change valve is closed to close connection between the pump passage and the fuel tank passage and to open connection between the atmosphere communication passage and the fuel tank passage. In the valve opening state, the change valve is opened to open the connection between the pump passage and the fuel tank passage and to close the connection between the atmosphere communication passage and the fuel tank passage. The pressure sensing device is placed in the pump passage and senses a pressure in an inside of the pump passage. The control device includes a pump drive unit and a change valve control unit. The pump drive unit controls an operation of the pump. The change valve control unit executes a turning-on control operation of the change valve, which opens the change valve, and a turning-off control operation of the change valve, which closes the change valve. The control device executes a fuel vapor leakage sensing process that is executed to sequentially perform a first reference pressure sensing operation, the turning-on control operation, a tank pressure sensing operation, the turning-off control operation and a second reference pressure sensing operation. The first reference pressure sensing operation is performed to measure a first reference pressure, which is a pressure of an inside of the pump passage in the valve closing state of the change valve upon driving of the pump, through the pressure sensing device. The turning-on control operation is performed to turn on the change valve and thereby to open the change valve after the first reference pressure sensing operation. The tank pressure sensing operation is performed to measure a tank pressure, which is a pressure of the inside of the pump passage in the valve opening state of the change valve upon driving of the pump after the turning-on control operation. The leakage sensing operation is performed to sense leakage of fuel vapor from the fuel tank based on the tank pressure after the tank pressure sensing operation. The turning-off control operation is performed to turn off the change valve and thereby to close the change valve after the leakage sensing operation. The second reference pressure sensing operation is performed to measure a second reference pressure, which is a pressure of the inside of the pump passage in the valve closing state of the change valve upon driving of the pump after the turning-off control operation, through the pressure sensing device. The control device executes abnormality determination of the change valve when a difference between the first reference pressure, which is measured in an nth execution of the fuel vapor leakage sensing process, and the second reference pressure, which is measured in an (n−1) th execution of the fuel vapor leakage sensing process, is equal to or larger than a predetermined threshold value, where n is an integer that is equal to or larger than 2.

According to the present disclosure, there is also provided a fuel vapor leakage sensing method, which is executed with the fuel vapor leakage sensing apparatus. In the fuel vapor leakage sensing method, the first reference pressure sensing operation is executed. Then, the abnormality determination of the change valve is executed based on the difference between the first reference pressure, which is measured in the nth execution of the fuel vapor leakage sensing process, and the second reference pressure, which is measured in the (n−1)th execution of the fuel vapor leakage sensing process. Next, it is determined whether the fuel vapor is leaked based on the tank pressure in a case where the change valve is normal. Thereafter, the second reference pressure sensing operation is executed in the case where the change valve is normal.

BRIEF DESCRIPTION OF THE DRAWINGS

The drawings described herein are for illustration purposes only and are not intended to limit the scope of the present disclosure in any way.

FIG. 6 is a diagram showing an (n−1)th execution of the fuel vapor leakage sensing process of the fuel vapor leakage sensing apparatus of the first embodiment;

FIG. 7 is a diagram showing an nth execution of the fuel vapor leakage sensing process of the fuel vapor leakage sensing apparatus of the first embodiment.

DETAILED DESCRIPTION

Various embodiments of the present disclosure will be described with reference to the accompanying drawings.

First Embodiment

A fuel vapor leakage sensing apparatus according to a first embodiment of the present disclosure is used in a fuel vapor processing system to sense leakage of fuel vapor generated in a fuel tank.

Figure 1:
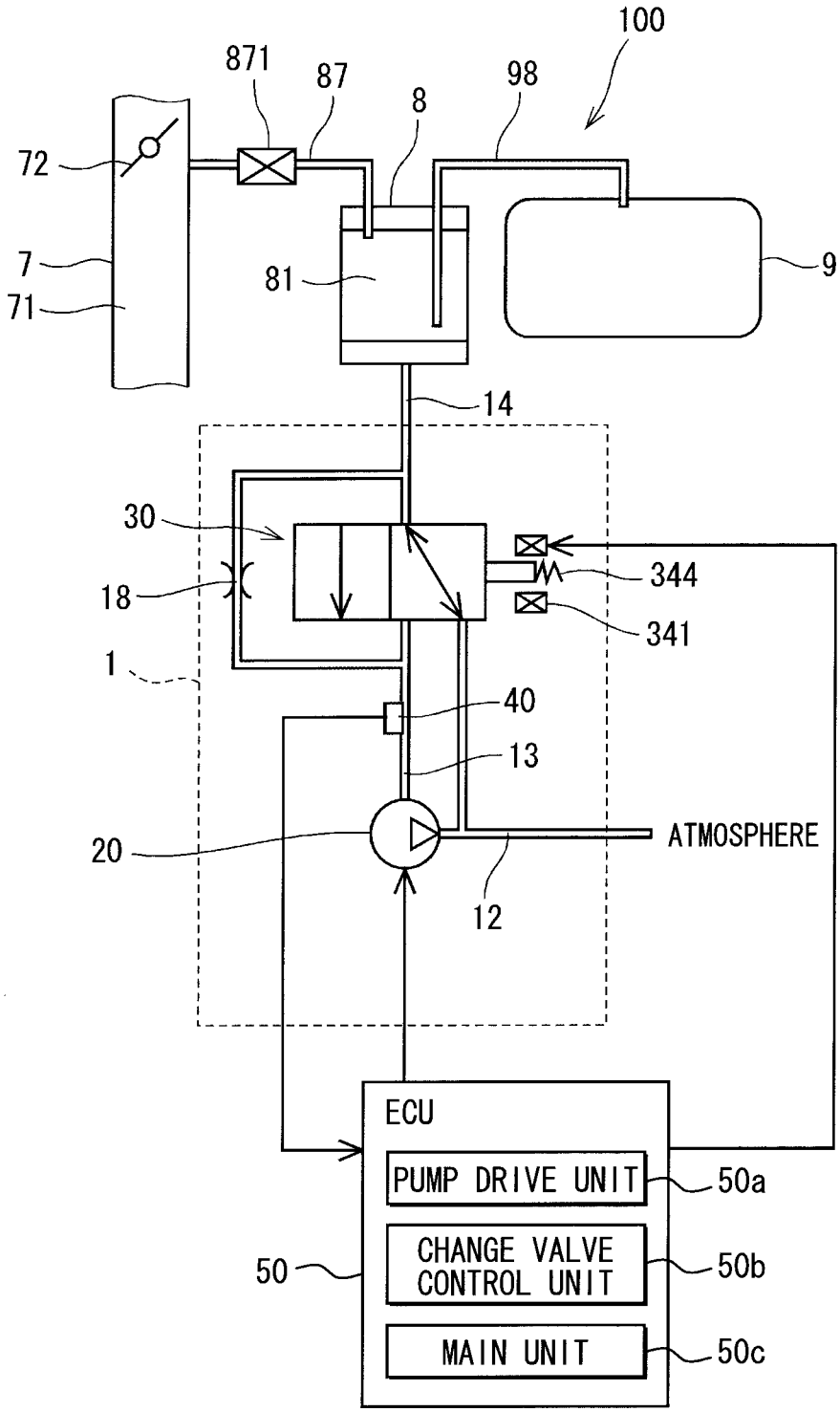
FIG. 1 is a schematic diagram showing a structure of a fuel vapor processing system having a fuel vapor leakage sensing apparatus according to a first embodiment of the present disclosure.

As shown in FIG. 1, the fuel vapor processing system 100 includes the fuel tank 9, a canister 8 and the fuel vapor leakage sensing apparatus 1. The fuel vapor processing system 100 collects the fuel vapor, which is generated in the fuel tank 9, into the canister 8. Thereafter, the fuel vapor processing system 100 purges the collected fuel vapor, which is collected in the canister 8, into an intake passage 71 of an intake pipe 7, which is connected to an internal combustion engine of a vehicle (e.g., an automobile).

The fuel tank 9 stores fuel to be supplied to the engine. The fuel tank 9 is connected to the canister 8 through a first purge pipe 98. The first purge pipe 98 communicates between an inside of the fuel tank 9 and an inside of the canister 8.

The canister 8 has an adsorbent material 81, which adsorbs the fuel vapor generated in the fuel tank 9. The canister 8 is connected to the intake pipe 7 through a second purge pipe 87. The second purge pipe 87 communicates between the inside of the canister 8 and the intake passage 71 of the intake pipe 7. A purge valve 871 is installed in the second purge pipe 87. The fuel vapor, which is generated in the fuel tank 9, is supplied to the canister 8 through a passage of the first purge pipe 98 and is adsorbed onto the adsorbent material 81, which is received in the canister 8. Thereafter, the adsorbed fuel vapor, which is adsorbed onto the adsorbent material 81 in the canister 8, is purged into the intake passage 71 on the downstream side of the throttle valve 72 through the second purge pipe 87. The purge valve 871 is a solenoid valve and adjusts the amount of fuel vapor, which passes through the passage of the second purge pipe 87.

Next, the fuel vapor leakage sensing apparatus 1 of the present embodiment will be described with reference to FIGS. 1 to 4.

Figure 2:
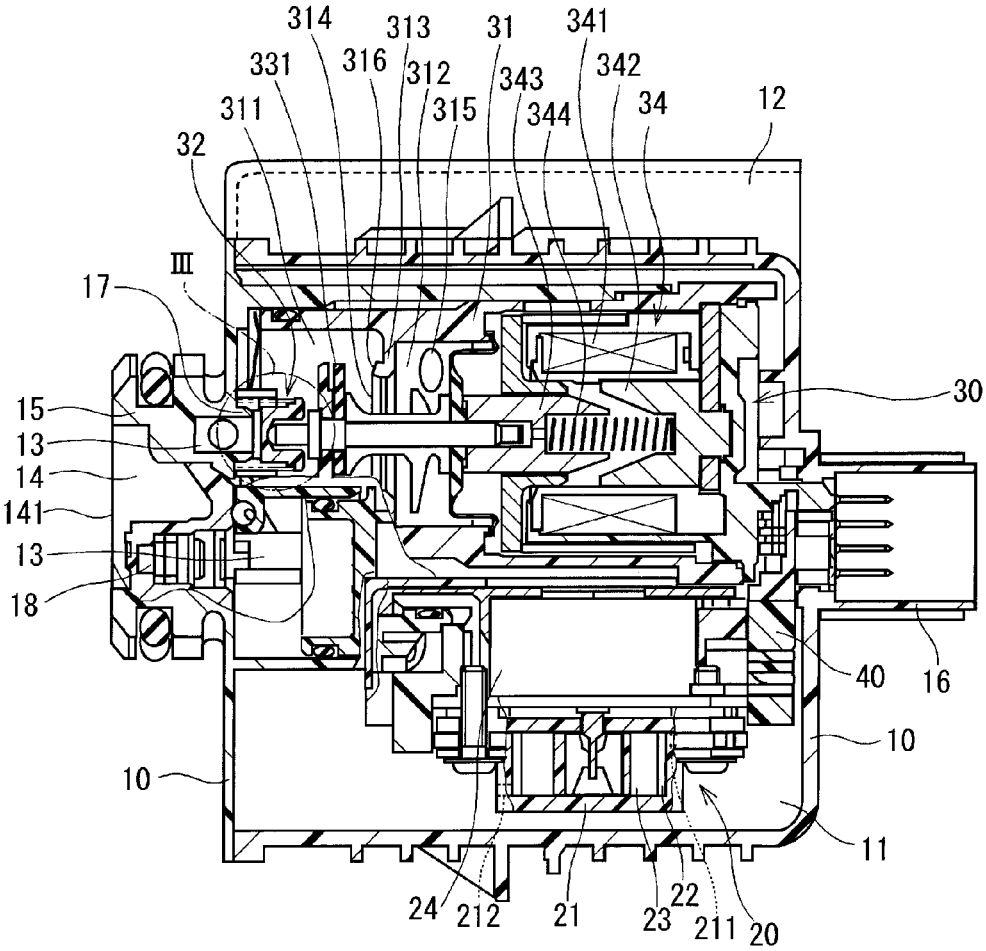
FIG. 2 is a cross-sectional view of the fuel vapor leakage sensing apparatus of the first embodiment.

As shown in FIGS. 1 and 2, the fuel vapor leakage sensing apparatus 1 includes a housing 10, a pump 20, a change valve 30, a pressure sensor 40 and an electronic control unit (ECU) 50. The pressure sensor 40 serves as a pressure sensing device (also referred to as a pressure sensing means). The ECU 50 serves as a control device. The fuel vapor leakage sensing apparatus 1 senses leakage of the fuel vapor from the fuel tank 9 and the canister 8 by depressurizing the inside of the fuel tank 9 and the inside of the canister 8 with the pump 20.

The housing 10 is configured generally into a cubic form and is made of a resin material. As shown in FIG. 2, the housing 10 receives the pump 20, the change valve 30 and the pressure sensor 40. The housing 10 includes a pump receiving space 11 and an atmosphere communication passage 12. The atmosphere communication passage 12 communicates between the pump receiving space 11 and an outside of the housing 10. The pump receiving space 11 and the atmosphere communication passage 12 may collectively serve as an atmosphere communication passage.

The housing 10 further includes a pump passage 13 and a canister passage 14. The pump passage 13 is communicated with the pump receiving space 11. The canister passage 14 serves as a fuel tank passage. The pump passage 13 and the canister passage 14 are communicated with each other through an orifice 18. The canister passage 14 has a canister connecting port 141, which opens to a canister connecting portion 15.

As shown in FIG. 1, the pump passage 13 is connected to the pump 20 through one end portion of the pump passage 13. The fuel tank passage 14 is communicated with the fuel tank 9 through one end portion of the fuel tank passage 14 and is connected to the other end portion of the pump passage 13, which is opposite from the one end portion of the pump passage 13, through the other end portion of the fuel tank passage 14, which is opposite from the one end portion of the fuel tank passage 14. The atmosphere communication passage 12 is opened to the atmosphere through one end portion of the atmosphere communication passage 12 and is connected to the other end portion of the fuel tank passage 14 through the other end portion of the atmosphere communication passage 12, which is opposite from the one end portion of the atmosphere communication passage 12.

In the present embodiment, the fuel vapor leakage sensing apparatus 1 is connected to the canister 8, and the canister passage 14 is communicated with the inside of the canister 8 through the canister connecting port 141. A connector 16 is provided to an opposite side of the housing 10, which is opposite from the canister connecting portion 15. In the housing 10, a first valve seat 17 is formed in an end portion of the pump passage 13, which is opposite from the pump receiving space 11.

The pump 20 is received in the pump receiving space 11 of the housing 10 and is placed between the pump receiving space 11 and the pump passage 13. The pump 20 includes a pump housing 21, vanes 22, a rotor 23 and an electric motor 24. The vanes 22 are slidable along an inner wall of the pump housing 21 and are supported by the rotor 23. The electric motor 24 drives the rotor 23 to rotate the rotor 23. The pump housing 21 includes a suction port 211 and a discharge port 212. In the present embodiment, the suction port 211 of the pump 20 opens to the pump passage 13, and the discharge port 212 of the pump 20 opens to the pump receiving space 11. When the rotor 23 is rotated, the gas in the pump housing 21 is outputted from the discharge port 212 into the pump receiving space 11. Thereby, the negative pressure is generated in the pump housing 21. Then, the gas in the pump passage 13 is drawn into the pump housing 21 through the suction port 211. The motor 24 is electrically connected to the ECU 50.

The change valve 30 is received in the housing 10 and is connected to the canister passage 14, the pump passage 13 and the pump receiving space 11. The change valve 30 includes a valve body 31, a first valve element 32, a valve shaft 33 and a solenoid drive device 34. The valve shaft 33 has a second valve element 331.

The valve body 31 is configured generally into a tubular form. One end portion of the valve body 31 is configured to correspond with an end portion of the pump passage 13, which is opposite from the pump 20. That is, the valve body 31 is placed such that the one end portion of the valve body 31 corresponds to the first valve seat 17. A through-hole portion 313 is formed in an axial intermediate portion of the valve body 31. The through-hole portion 313 includes a through-hole 314 in an center part of the through-hole portion 313. An inside of the valve body 31 is partitioned by the through-hole portion 313. A first connecting space 311 and a second connecting space 312 are provided on one side and the other side, respectively, of the through-hole portion 313. Here, the first connecting space 311 is communicated with the canister passage 14 and the pump passage 13. The second connecting space 312 is communicated with the pump receiving space 11 through the communication hole 315 formed in the valve body 31. A second valve seat 316 is formed in the through-hole portion 313 on the first connecting space 311 side.

Figure 3:
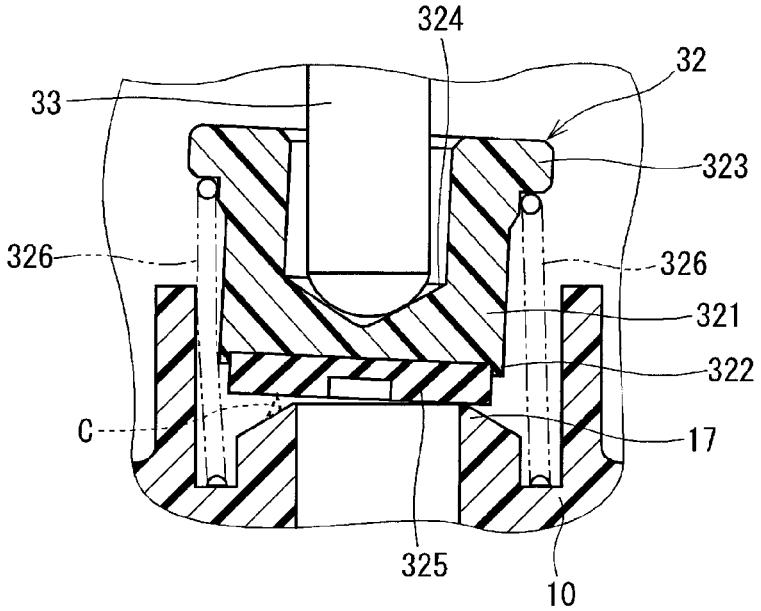
FIG. 3 is a partial enlarged view of an area III in FIG. 2, showing an incomplete valve closing state of a change valve of the fuel vapor leakage sensing apparatus.
Figure 4:
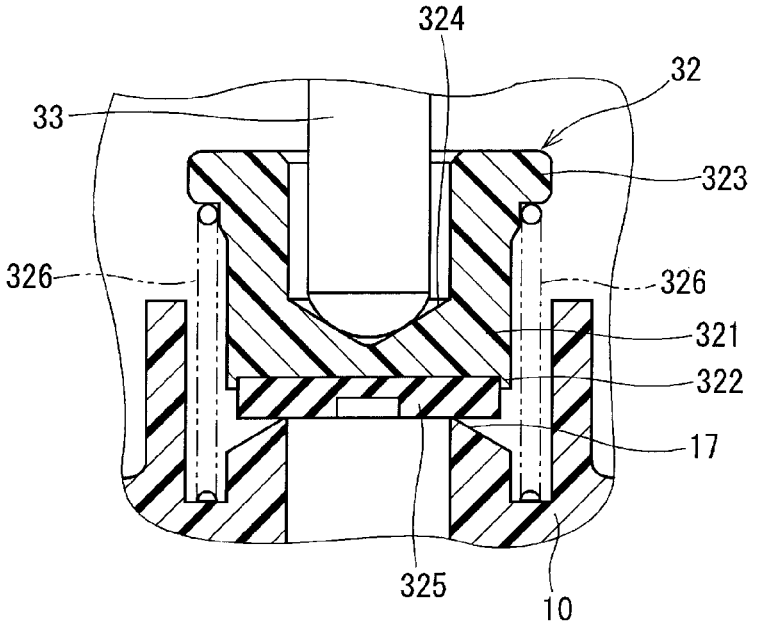
FIG. 4 is another partial enlarged view of the area III in FIG. 2, showing a complete valve closing state of the change valve of the fuel vapor leakage sensing apparatus.

As shown in FIG. 3, the first valve element 32 is place such that the first valve element 32 is contactable with the first valve seat 17. The first valve element 32 includes a main body 321, a distal end portion 322, a flange 323 and a contact recess 324. The main body 321 is configured generally into a U-shape form, as shown in FIG. 3. The distal end portion 322 is formed in the main body 321 on a first valve seat 17 side. A cushion member 325 is placed on the first valve seat 17 side of the distal end portion 322. The distal end portion 322 is contactable with the first valve seat 17 through the cushion member 325. The flange 323 radially outwardly projects from a base end portion of the main body 321, which is opposite from the distal end portion 322 of the main body 321. The contact recess 324 is formed such that the contact recess 324 is axially recessed in a center part of the base end portion of the main body 321, which is opposite from the distal end portion 322, toward the distal end portion 322 of the main body 321. A spring 326 is held between the flange 323 of the main body 321 and the inner wall of the housing 10. The spring 326 axially urges the main body 321 on a side, which is opposite from the first valve seat 17.

The valve shaft 33 is placed in the inside of the valve body 31 such that the second valve element 331 is received in the first connecting space 311. Furthermore, the valve shaft 33 is axially reciprocatable, i.e., is adapted to reciprocate in the axial direction. One end portion of the valve shat 33 contacts a bottom wall of the contact recess 324 of the first valve element 32. A movable core 343 of a solenoid drive device 34 is provided to the other end portion of the valve shaft 33, which is opposite from the first valve element 32.

The solenoid drive device 34 is provided at the other end portion of the valve body 31 and includes a coil 341, a stationary core 342, the movable core 343 and a spring 344. The coil 341 is electrically connected to the ECU 50 through a connector 16. The stationary core 342 is securely held at a location, which is on a radially inner side of the coil 341. The movable core 343 is provided to the other end portion of the valve shaft 33. The spring 344 is placed between the stationary core 342 and the movable core 343. The spring 344 urges the movable core 343 toward the first valve seat 17. Here, when the coil 341 is energized, a magnetic attractive force is generated between the stationary core 342 and the movable core 343, and thereby the movable core 343 is axially moved together with the valve shaft 33 toward the stationary core 342.

The urging force of the spring 326 is set to be smaller than the urging force of the spring 344. Therefore, in the state where the coil 341 of the solenoid drive device 34 is not energized, the spring 344 urges the main body 321 of the first valve element 32 toward the first valve seat 17 through the movable core 343 and the valve shaft 33. Therefore, the main body 321 of the first valve element 32 is seated against the first valve seat 17, and thereby the canister communication passage 14 and the first connecting space 311 are discommunicated from the pump passage 13. Furthermore, at this time, the second valve element 331 is lifted away from the second valve seat 316, so that the through-hole 314 is opened. Thereby, the canister passage 14 and the first connecting space 312 are communicated with the second connecting space 312, the pump receiving space 11 and the atmosphere communication passage 12 through the through-hole 314.

In the following discussion, the state, in which the coil 341 of the solenoid drive device 34 is not energized, i.e., the state, in which the first valve element 32 is seated against the first valve seat 17, will be referred to as a valve closing state. The valve closing state includes a complete valve closing state and an incomplete valve closing state. The complete valve closing state refers to a state, in which a gap is not present between the first valve element 32 and the first valve seat 17 (see FIG. 4). Furthermore, the incomplete valve closing state refers to a state, in which the first valve element 32 is seated against the first valve seat 17 while the first valve element 32 is tilted relative to the valve shaft 33, so that a gap is present between the first valve element 32 and the first valve seat 17 (see FIG. 3).

When the coil 341 of the solenoid drive device 34 is energized, the movable core 343 and the valve shaft 33 are moved toward the stationary core 342 side by the magnetic attractive force generated between the stationary core 342 and the movable core 343. At this time, the main body 321 of the first valve element 32 is lifted away from the first valve seat 17 by the urging force of the spring 326. Thereby, the canister passage 14 and the first connecting space 311 are communicated with the pump passage 13. Furthermore, at this time, the second valve element 331 is seated against the second valve seat 316, so that the through-hole 314 is closed. Thereby, the canister passage 14 and the first connecting space 312 are discommunicated from the second connecting space 312, the pump receiving space 11 and the atmosphere communication passage 12. In the following discussion, the state, in which the coil 341 of the solenoid drive device 34 is energized, i.e., the state, in which the first valve element 32 is lifted away from the first valve seat 17, will be referred to as a valve opening state.

The pressure sensor 40 is placed in the pump passage 13 on the side that is opposite from the canister connecting portion 15 of the housing 10. The pressure sensor 40 is electrically connected to the ECU 50 through the connector 16.

The ECU 50 is formed by a microcomputer that has a CPU, a RAM and a ROM. The CPU serves as a computing means, and the RAM and the ROM serve as a storage means. The ECU 50 is electrically connected to the pressure sensor 40, the pump 20 and the solenoid drive device 34 of the change valve 30. The ECU 50 executes the turning-on control operation (also referred to as an ON control operation) and the turning-off control operation (also referred to as an OFF control operation) of the change valve 30 to control the driving operation of the pump 20 based on a signal that is generated in response to the pressure of the pump passage 13 measured with the pressure sensor 40. The Turning-on control operation is the operation that opens the change valve 30. The Turning-off control operation of the change valve 30 is the operation that closes the change valve 30.

Figure 5:
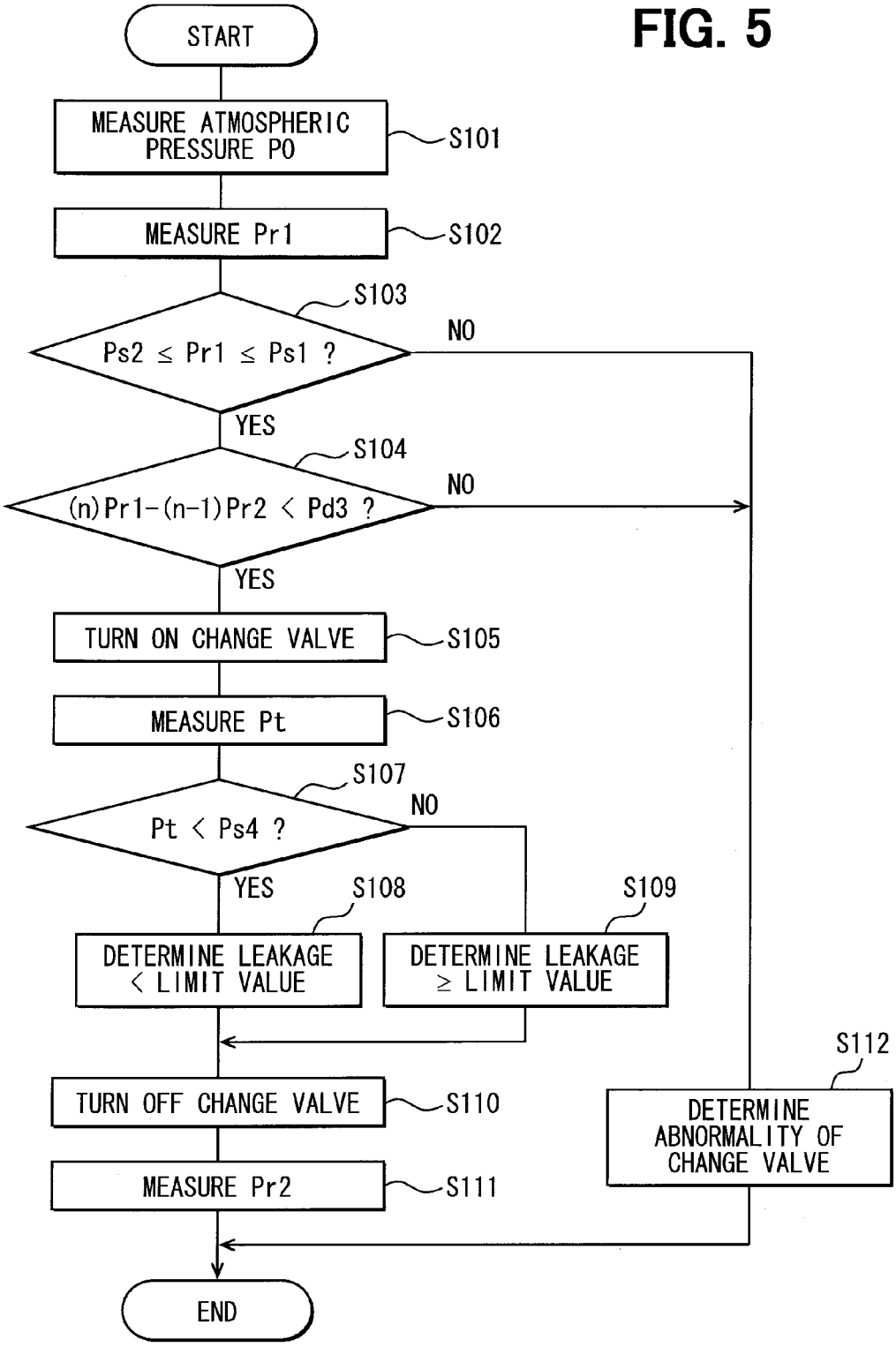
FIG. 5 is a flowchart showing a fuel vapor leakage sensing process of the fuel vapor leakage sensing apparatus of the first embodiment.

Next, the operation of the fuel vapor leakage sensing apparatus 1 of the present embodiment will be described with reference to FIGS. 5 to 7. FIG. 5 shows a process flow of a leakage sensing process (a fuel vapor leakage sensing process) that is executed by the ECU 50 to sense leakage of the fuel vapor. The ECU 50 serves as the control device and includes a pump drive unit (also referred to as a pump drive means) 50*a*, a change valve control unit (also referred to as a change valve control means) 50*b* and a main unit 50*c*. The pump drive unit 50*a* of the ECU 50 controls the operation of the pump 20. The change valve control unit 50*b* controls the operation of the change valve 30. More specifically, the change valve control unit 50*b* executes the turning-on control operation of the change valve 30, which opens the change valve 30, and the turning-off control operation of the change valve 30, which closes the change valve 30. The turning-on control operation and the turning-off control operation will be described in detail later. The other operations of the ECU 50, which are other than the operations of the pump drive unit 50*a* and of the change valve control unit 50*b* are executed by the main unit 50*c* of the ECU 50. Therefore, it should be understood that the most of the operations of the ECU 50 discussed below are executed by the main unit 50*c* unless otherwise states. FIGS. 6 and 7 show changes in the pressure in the pump passage 13 with time at the time of executing the leakage sensing process. Specifically, FIG. 6 shows the (n−1) th execution of the leakage sensing process, and FIG. 7 shows the nth execution of the leakage sensing process. Here, n is an integer that is equal to or larger than 2.

The process of FIG. 5 starts when a predetermined time period elapses from the time of stopping the operation of the engine. This predetermined time period is set as a time period that is required to stabilize a temperature of the vehicle.

At step S101, the ECU 50 senses the atmospheric pressure P0. At this time (see a time period A shown in FIGS. 6 and 7), the electric power of the pump 20 and the electric power of the change valve 30 are both turned off. That is, the change valve 30 is in the valve closing state, in which the first valve element 32 is seated against the first valve seat 17. The pump passage 13 is in an atmosphere communicating state, in which the pump passage 13 is communicated with the atmosphere through the inside of the pump 20, the pump receiving space 11 and the atmosphere passage 12. Therefore, a pressure, which is measured with the pressure sensor 40 placed in the pump passage 13, can be measured as the atmospheric pressure P0. The ECU 50 stores a value of a signal, which is outputted from the pressure sensor 40, as a value that corresponds to the atmospheric pressure P0 in the RAM.

At step S102, the ECU 50 senses a reference pressure Pr through the pressure sensor 40. The reference pressure Pr is a minimum pressure in the pump passage 13 upon driving the pump 20 in the valve closing state of the change valve 30.

At this time, the pump passage 13 and the canister passage 14 are not directly communicated with each other but are indirectly communicated with each other through the orifice 18. Therefore, the pressure in the pump passage 13 is reduced by the pump 20, which is driven by the ECU 50 (more specifically, the pump drive unit 50*a* of the ECU 50). At this time (a time period B in FIGS. 6 and 7), the ECU 50 stores a pressure, which is measured with the pressure sensor 40, as a first reference pressure Pr1 in the RAM.

At step S103, the ECU 50 determines whether a value of the first reference pressure Pr1, which is measured at step S102, is within a predetermined pressure range. The predetermined pressure range is defined as a range that is between a first threshold value Ps1 and a second threshold value Ps2. When it is determined that the first reference pressure Pr1 is equal to or less than the first threshold value Ps1 and is equal to or larger than the second threshold value Ps2 at step S103 (i.e., YES at step S103), the ECU 50 proceeds to step S104.

In contrast, when it is determined that the first reference pressure Pr1 is larger than the first threshold value Ps1 or smaller than the second threshold value Ps2 at step S103 (i.e., NO at step S103), the ECU 50 proceeds to step S112. At step S112, the ECU 50 determines that the change valve 30 is abnormal.

Here, when the first reference pressure Pr1 is larger than the first threshold value Ps1, it is conceivable that seal leakage is generated at the valve closing state of the change valve 30. Furthermore, when the first reference pressure Pr1 is smaller than the second threshold pressure Ps2, it is conceivable that a diameter of the orifice 18 is reduced by a foreign object(s) held in the orifice 18.

At step S104, the ECU 50 determines whether a value, which is obtained by subtracting a second reference pressure Pr2 measured in the (n−1)th execution of the leakage sensing process from the first reference pressure Pr1 measured in the nth execution of the leakage sensing process, is smaller than a third threshold value Pd3. The third threshold value Pd3 serves as a predetermined threshold value of the present disclosure. Here, the first reference pressure Pr1, which is measured in the nth execution of the leakage sensing process, is referred to as the first reference pressure (n)Pr1 of the nth execution of the leakage sensing process. Furthermore, the second reference pressure Pr2, which is measured in the (n−1)th execution of the leakage sensing process, is referred to as the second reference pressure (n−1)Pr2 of the (n−1)th execution of the leakage sensing process. When it is determined that the value, which is obtained by subtracting the second reference pressure (n−1)Pr2 measured in the (n−1)th execution of the leakage sensing process from the first reference pressure (n)Pr1 measured in the nth execution of the leakage sensing process, is smaller than the third threshold value Pd3 at step S104 (i.e., YES at step S104), the ECU 50 proceeds to step S105. In contrast, when it is determined that the value, which is obtained by subtracting the second reference pressure (n−1)Pr2 measured in the (n−1)th execution of the leakage sensing process from the first reference pressure (n)Pr1 measured in the nth execution of the leakage sensing process, is equal to or larger than the third threshold value Pd3 at step S104 (i.e., NO at step S104), the ECU 50 proceeds to step S112. Thereby, the abnormality determination of the change valve 30 is executed.

Here, when the leakage sensing process is executed for the first time at the time of, for example, factory shipment of the fuel vapor leakage sensing apparatus, the first reference pressure (n)Pr1 of the nth execution of the leakage sensing process is used as the second reference pressure (n−1)Pr2 of the (n−1)th execution of the leakage sensing process. That is, only in the case where the number n of the nth execution of the leakage sensing process is 1, the first reference pressure (1)Pr1 of the 1st execution of the leakage sensing process is used as the second reference pressure (0) of the 0th execution of the leakage sensing process.

At step S105, the ECU 50 (more specifically, the change valve control unit 50*b*) executes the turning-on control operation of the change valve 30. Thereby, the first valve element 32 is lifted away from the first valve seat 17, and thereby the canister communication passage 14 is communicated with the pump passage 13 through the first connecting space 311.

At step S106, the ECU 50 senses a pressure (hereinafter, referred to as a tank pressure) Pt of the fuel tank 9. When the change valve 30 is placed in the valve opening state at step S105, the pump passage 13 is communicated with the fuel tank 9 through the first connecting space 311, the canister passage 14 and the canister 8. Thereby, the pressure of the fuel tank 9 and the pressure of the pump passage 13 become equal to each other. Thus, the pressure of the pump passage 13, which is measured with the pressure sensor 40, corresponds to the pressure of the fuel tank 9. Furthermore, the pressure of the pump passage 13 is increased once. Then, when the pump 20 is driven, the tank pressure Pt, which is measured with the pressure sensor 40, is reduced over time, as indicated in a time period C of FIGS. 6 and 7.

At step S107, the ECU 50 determines whether the tank pressure Pt is smaller than a fourth threshold value Ps4. The fourth threshold value Ps4 is a value, which is computed by the ECU 50 based on the first reference pressure Pr1. When it is determined that the tank pressure Pt becomes lower than the fourth threshold value Ps4 in response to the driving of the pump 20 at step S107 (i.e., YES at step S107), the ECU 50 proceeds to step S108. When it is determined that the tank pressure Pt is equal to or larger than the fourth threshold value Ps4 at step S107 (i.e., NO at step S107), the ECU 50 proceeds to step S109.

At step S108, the ECU 50 determines that the fuel vapor leakage of the fuel tank 9 is smaller than a limit value. In the case where the pressure of the fuel tank 9 is lower than the fourth threshold value Ps4, it indicates that the intrusion of the air from the outside of the fuel tank 9 into the inside of the fuel tank 9 does not occur, and the airtightness of the fuel tank 9 is sufficiently achieved. Therefore, it is possible to determine that the fuel vapor, which is generated in the fuel tank 9, is not released to the outside of the fuel tank 9, and the fuel vapor leakage is smaller than the limit value.

At step S109, the ECU 50 determines that the fuel vapor leakage of the fuel tank 9 is equal to or larger than the limit value. In the case where the pressure of the fuel tank 9 does not decrease to the fourth threshold value Ps4, it is assumed that the intrusion of the air from the outside of the fuel tank 9 into the inside of the fuel tank 9 is taking place in response to the depressurization of the inside of the fuel tank 9. Therefore, it is assumed that the fuel vapor is released from the inside of the fuel tank 9 to the outside of the fuel tank 9 in the case where the fuel vapor is generated in the inside of the fuel tank 9. Therefore, in the case where the pressure of the fuel tank 9 does not decrease below the fourth threshold value Ps4, it can be determined that the fuel vapor leakage is equal to or larger than the limit value. When the ECU 50 determines that the fuel vapor leakage is equal to or larger than the limit value, the ECU 50 turns on a warning lamp of a dashboard of a passenger compartment of the vehicle at the time of driving the engine next time. In this way, a driver of the vehicle can recognize the occurrence of the fuel vapor leakage.

In the case where the pressure of the fuel tank 9 is generally equal to the fourth threshold value Ps4, a crack, a size of which is equal to a size of the orifice 18, may be formed in the fuel tank 9.

At step S110, the ECU 50 (more specifically, the change valve control unit 50*b*) executes the turning-off control operation of the change valve 30. As a result, the first valve element 32 is seated against the first valve seat 17, and thereby the direct communication between the pump passage 13 and the canister passage 14 is stopped. Therefore, the pressure in the pump passage 13 is reduced by the pump 20.

At step S111, the ECU 50 senses the reference pressure once again. At this time (a time period D in FIGS. 6 and 7), the ECU 50 stores a pressure, which is measured with the pressure sensor 40, as the second reference pressure Pr2 in the RAM. The second reference pressure Pr2 is the value, which is measured immediately after the execution of the turning-off control operation of the change valve 30. Therefore, there is the high possibility of that the second reference pressure Pr2 is the reference pressure at the time of complete valve closing state of the change valve 30. That is, the reliability of the second reference pressure Pr2 is higher than the reliability of the first reference pressure Pr1.

When the sensing process of the fuel vapor leakage is completed, the ECU 50 stops the energization of the pump 20 and the energization of the change valve 30. As indicated at a time period E of FIGS. 6 and 7, the state, at which the energization of the pump 20 and the energization of the change valve 30 are stopped, will be referred to as a leakage sensing process end state. Thereby, the pressure of the pump passage 13 is returned to the atmospheric pressure P0, as indicated in the time period E of FIGS. 6 and 7. When the ECU 50 confirms that the pressure of the pump passage 13 is returned to the atmospheric pressure P0, the ECU 50 stops the operation of the pressure sensor 40 and terminates the leakage sensing process.

As discussed above, the ECU 50 senses the abnormality of the change valve 30 by determining whether the value of the first reference pressure Pr1 is within the predetermined pressure range. In the case where the valve closing state of the change valve 30 is the incomplete valve closing state, the first reference pressure Pr1 may possibly be reduced below the second threshold value Ps2 and thereby fall in the outside of the predetermined pressure range due to the seal leakage between the first valve element 32 and the first valve seat 17. At this time, the ECU 50 determines that the change valve 30 is abnormal. However, in the incomplete valve closing state of the change valve 30, when the level of the seal leakage between the first valve element 32 and the first valve seat 17 is low, the first reference pressure Pr1 is within the predetermined pressure range. Therefore, in the case where the level of the seal leakage between the first valve element 32 and the first valve seat 17 is low, the abnormality of the change valve 30 may not be sensed based on the result of the determination of whether the first reference pressure Pr1 is within the predetermined pressure range.

Thus, in the present embodiment, the ECU 50 determines that the change valve 30 is abnormal in the case where the value, which is obtained by subtracting the second reference pressure (n−1)Pr2 measured in the (n−1)th execution of the leakage sensing process from the first reference pressure (n)Pr1 measured in the nth execution of the leakage sensing process, is equal to or larger than the third threshold value Pd3. Thereby, the seal leakage at the time of valve closing of the change valve 30 can be sensed based on the change in the reference pressure. The second reference pressure Pr2 is the value, which is measured immediately after the execution of the turning-off control operation of the change valve 30. Therefore, there is the high possibility of that the second reference pressure Pr2 is the reference pressure at the time of complete valve closing state of the change valve 30. Therefore, the value, which is obtained by subtracting the second reference pressure (n−1)Pr2 measured in the (n−1)th execution of the leakage sensing process from the first reference pressure (n)Pr1 measured in the nth execution of the leakage sensing process, can correctly reflect the valve closing state of the change valve 30 at the time of sensing the first reference pressure (n)Pr1 of the nth execution of the leakage sensing process. That is, even in the case where the value of the first reference pressure (n)Pr1 is within the predetermined pressure range, when the value, which is obtained by subtracting the second reference pressure (n−1)Pr2 measured in the (n−1)th execution of the leakage sensing process from the first reference pressure (n)Pr1 measured in the nth execution of the leakage sensing process, is equal to or larger than the third threshold value Pd3, the possibility of the abnormality of the change valve 30 is high. Thus, even in the case where the level of the seal leakage between the first valve element 32 and the first valve seat 17 is low, the ECU 50 can sense the abnormality of the change valve 30 based on the value, which is obtained by subtracting the second reference pressure (n−1)Pr2 measured in the (n−1)th execution of the leakage sensing process from the first reference pressure (n)Pr1 measured in the nth execution of the leakage sensing process.

Second Embodiment

Figure 8:
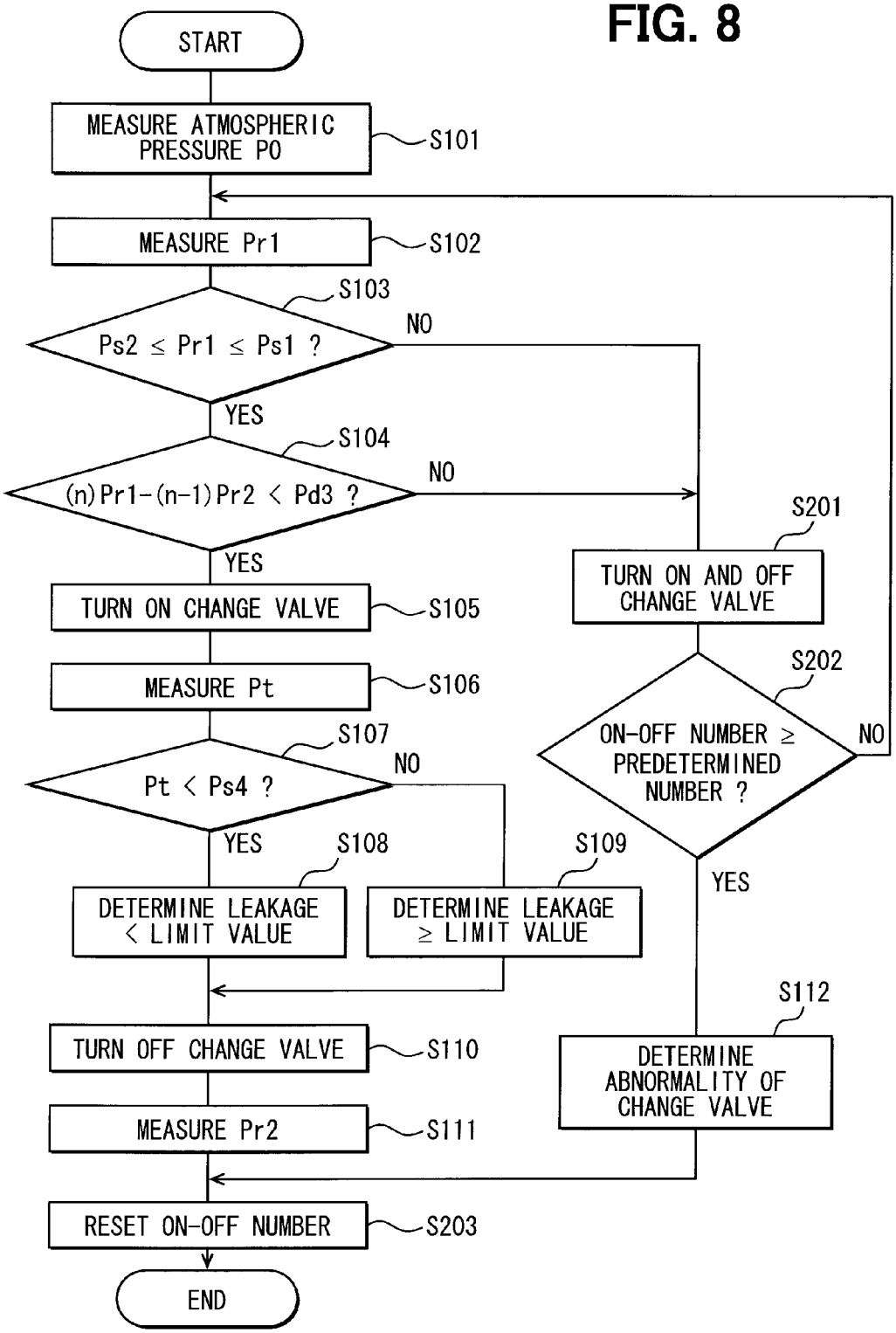
FIG. 8 is a flowchart showing a fuel vapor leakage sensing process of a fuel vapor leakage sensing apparatus according to a second embodiment of the present disclosure.

Now, a second embodiment of the present disclosure will be described with reference to FIG. 8. The fuel vapor leakage sensing apparatus of the second embodiment is similar to that of the first embodiment except the fuel vapor leakage sensing process executed by the ECU 50. Therefore, in the following discussion, this difference is mainly described. FIG. 8 is a flowchart showing the fuel vapor leakage sensing process executed by the ECU 50 of the fuel vapor leakage sensing apparatus according to the second embodiment of the present disclosure. The fuel vapor leakage sensing process of FIG. 8 is substantially the same as the fuel vapor leakage sensing process (see FIG. 5) of the first embodiment except that steps S201-S203 are added in the fuel vapor leakage sensing process of FIG. 8. Therefore, the discussion of other steps of FIG. 8, which are other than steps S201-S203, will be omitted for the sake of simplicity.

At step S201, the ECU 50 (more specifically, the change valve control unit 50*b*) executes a turning-on and turning-off control operation of the change valve 30 (also referred to as an ON-OFF control operation, which turns on and off the change valve 30) once. The turning-on and turning-off control operation includes a turning-on control operation and a turning-off control operation of the change valve 30, which are executed one after another. In the turning-on control operation, the electric supply to the solenoid drive device 34 of the change valve 30 is turned on once. Thereafter, in the turning-off control operation, the electric supply to the solenoid drive device of the change valve 30 is turned off once. Furthermore, the ECU 50 counts a cumulative number of the execution(s) of the turning-on and turning-off control operation (the ON-OFF control operation) of the change valve 30 and stores the counted cumulative number in the RAM.

At step S202, the ECU 50 determines whether the cumulative number of the execution(s) of the turning-on and turning-off control operation (the ON-OFF control operation), which is executed at step S201, is equal to or larger than a predetermined number every time the process of the flowchart of FIG. 8 is executed. The cumulative number of the execution(s) of the turning-on and turning-off control operation (the ON-OFF control operation) may be simply referred to as a cumulative ON-OFF number (or simply referred to as an ON-OFF number) of the change valve 30. When it is determined that the cumulative number of the execution(s) of the turning-on and turning-off control operation (the ON-OFF control operation), which is executed at step S201, is equal to or larger than the predetermined number at step S202 (i.e., YES at step S202), the ECU 50 proceeds to step S112.

In contrast, when it is determined that the cumulative number of the execution(s) of the turning-on and turning-off control operation (the ON-OFF control operation), which is executed at step S201, is not equal to or larger than the predetermined number at step S202 (i.e., NO at step S202), the ECU 50 returns to step S102.

At step S203, which is executed after step S112 or step S111, the ECU 50 resets the stored cumulative number of the execution(s) of the ON-OFF control operation of the change valve 30 stored in the RAM.

As described above, according to the present embodiment, the ECU 50 executes the turning-on and turning-off control operation (the ON-OFF control operation) on the change valve 30 to reciprocate the first valve element 32 and the second valve element 331, so that the foreign object(s) C, which is accumulated between the second valve element 331 and the second valve seat 316, can possibly be eliminated. Therefore, it is possible to limit the seal leakage between the first valve element 32 and the first valve seat 17 or the seal leakage between the second valve element 331 and the second valve seat 316.

Furthermore, according to the present embodiment, in the case where the seal leakage of the change valve 30 cannot be eliminated even upon the execution of the turning-on and turning-off control operation (the ON-OFF control operation) of the change valve 30 for the predetermined number of times, the ECU 50 determines that the change valve 30 is abnormal. In this way, it is possible to sense the abnormality of the change valve 30, which cannot be overcome by the turning-on and turning-off control operation (the ON-OFF control operation) of the change valve 30.

Now, modifications of the above embodiments will be described.

In the first and second embodiments, the fuel vapor leakage of the fuel tank and the canister is sensed through the depressurization of the inside of the fuel tank and the inside of the canister. Alternatively, in one modification of the above embodiment(s), the leakage of the fuel of the fuel tank can be sensed through increasing of the pressure in the inside of the fuel tank.

In the first and second embodiments, the abnormality of the change valve is sensed based on the value, which is obtained by subtracting the second reference pressure measured in the (n−1)th execution of the leakage sensing process from the first reference pressure measured in the nth execution of the leakage sensing process. In another modification of the above embodiment(s), the abnormality of the orifice may be sensed based on the value, which is obtained by subtracting the second reference pressure measured in the (n−1)th execution of the leakage sensing process from the first reference pressure measured in the nth execution of the leakage sensing process.

In the second embodiment, at step S201, the turning-on and turning-off control operation (the ON-OFF control operation) is performed such that the turning on of the electric supply to the solenoid drive device 34 of the change valve 30 is executed once, and the turning off of the electric supply to the solenoid drive device 34 of the change valve 30 is executed once. In a modification of the second embodiment, at step S201, the turning-on and turning-off control operation (the ON-OFF control operation) may be performed such that the turning-on of the electric supply to the solenoid drive device 34 of the change valve 30 and the turning-off of the electric supply to the solenoid drive device 34 of the change valve 30 are alternately executed multiple times.

The present disclosure is not limited to the above embodiments, and the above embodiments may be modified in various ways within the principle of the present disclosure.

What is claimed is:

1. A fuel vapor leakage sensing apparatus, which generates a pressure difference between an inside and an outside of a fuel tank to sense leakage of fuel vapor from the fuel tank, the fuel vapor leakage sensing apparatus comprising:

a pump;

a housing that receives the pump, wherein the housing includes:

a pump passage that is connected to the pump through one end portion of the pump passage;

a fuel tank passage that is communicated with the fuel tank through one end portion of the fuel tank passage and is connected to the other end portion of the pump passage, which is opposite from the one end portion of the pump passage, through the other end portion of the fuel tank passage, which is opposite from the one end portion of the fuel tank passage; and an atmosphere communication passage that is opened to the atmosphere through one end portion of the atmosphere communication passage and is connected to the other end portion of the fuel tank passage through the other end portion of the atmosphere communication passage, which is opposite from the one end portion of the atmosphere communication passage;

a change valve that is placed in the housing, wherein the pump passage and the atmosphere communication passage are located on one side of the change valve, and the fuel tank passage is located on the other side of the change valve, which is opposite from the one side of change valve, and an operational state of the change valve is changeable between:

a valve closing state, in which the change valve is closed to close connection between the pump passage and the fuel tank passage and to open connection between the atmosphere communication passage and the fuel tank passage; and a valve opening state, in which the change valve is opened to open the connection between the pump passage and the fuel tank passage and to close the connection between the atmosphere communication passage and the fuel tank passage;

a pressure sensing device that is placed in the pump passage and senses a pressure in an inside of the pump passage; and a control device that includes:

a pump drive unit that controls an operation of the pump; and a change valve control unit that executes a turning-on control operation of the change valve, which opens the change valve, and a turning-off control operation of the change valve, which closes the change valve, wherein:

the control device executes a fuel vapor leakage sensing process that is executed to sequentially perform:

a first reference pressure sensing operation that is performed to measure a first reference pressure, which is a pressure of an inside of the pump passage in the valve closing state of the change valve when the pump is turned on, through the pressure sensing device;

the turning-on control operation;

a tank pressure sensing operation that is performed to measure a tank pressure, which is a pressure of the inside of the pump passage in the valve opening state of the change valve upon driving of the pump;

a leakage sensing operation that is performed to sense leakage of fuel vapor from the fuel tank based on the tank pressure;

the turning-off control operation; and a second reference pressure sensing operation that is performed to measure a second reference pressure, which is a pressure of the inside of the pump passage in the valve closing state of the change valve when the pump is turned on after the turning-off control operation, through the pressure sensing device; and the control device executes abnormality determination of the change valve when a difference between the first reference pressure, which is measured in an nth execution of the fuel vapor leakage sensing process, and the second reference pressure, which is measured in an (n−1)th execution of the fuel vapor leakage sensing process, is equal to or larger than a predetermined threshold value, where n is an integer that is equal to or larger than 2.

2. The fuel vapor leakage sensing apparatus according to claim 1, wherein the control device determines that the change valve is abnormal when a value, which is obtained by subtracting the second reference pressure measured in the (n−1)th execution of the fuel vapor leakage sensing process from the first reference pressure measured in the nth execution of the fuel vapor leakage sensing process, is equal to or larger than the predetermined threshold value.

3. The fuel vapor leakage sensing apparatus according to claim 2, wherein the change valve control unit executes both of the turning-on control operation and the turning-off control operation at least once when the change valve is determined to be abnormal by the control device.

4. A fuel vapor leakage sensing method, which is executed with the fuel vapor leakage sensing apparatus of claim 1, the fuel vapor leakage sensing method comprising:

executing the first reference pressure sensing operation;

executing the abnormality determination of the change valve based on the difference between the first reference pressure, which is measured in the nth execution of the fuel vapor leakage sensing process, and the second reference pressure, which is measured in the (n−1)th execution of the fuel vapor leakage sensing process;

determining whether the fuel vapor is leaked based on the tank pressure in a case where the change valve is normal; and executing the second reference pressure sensing operation in the case where the change valve is normal.

* * * * *